US010415268B1

(12) United States Patent
Rickrode

(10) Patent No.: US 10,415,268 B1
(45) Date of Patent: Sep. 17, 2019

(54) SYSTEM AND METHOD FOR SIMPLE MODULAR AND FLEXIBLE "BLIND VAULT LOCK" DESIGN TO SECURE SHIPMENT OF HIGH-VALUE CARGO

(71) Applicant: C. Joseph Rickrode, Nashua, NH (US)

(72) Inventor: C. Joseph Rickrode, Nashua, NH (US)

( * ) Notice: Subject to any disclaimer, the term of this patent is extended or adjusted under 35 U.S.C. 154(b) by 0 days.

(21) Appl. No.: 16/160,028

(22) Filed: Oct. 15, 2018

Related U.S. Application Data

(60) Provisional application No. 62/574,779, filed on Oct. 20, 2017.

(51) Int. Cl.

| | |
|---|---|
| ***E05B 17/22*** | (2006.01) |
| ***E05B 83/08*** | (2014.01) |
| ***E05B 47/00*** | (2006.01) |
| ***E05B 65/06*** | (2006.01) |
| ***E05C 7/04*** | (2006.01) |
| ***E05B 63/00*** | (2006.01) |
| ***E05B 77/44*** | (2014.01) |

(Continued)

(52) U.S. Cl.
CPC ..... *E05B 17/22* (2013.01); *E05B 17/2026* (2013.01); *E05B 47/0603* (2013.01); *E05B 63/0004* (2013.01); *E05B 65/06* (2013.01); *E05B 77/44* (2013.01); *E05B 83/08* (2013.01); *E05C 7/045* (2013.01); *E05B 2047/0063* (2013.01); *E05B 2047/0082* (2013.01); *E05B 2047/0091* (2013.01); *E05B 2047/0094* (2013.01); *E05B 2047/0095* (2013.01)

(58) Field of Classification Search
CPC ..... E05B 17/2026; E05B 17/22; E05B 47/00; E05B 47/0603; E05B 49/00; E05B 63/0004; E05B 63/06; E05B 77/44; E05B 83/02; E05B 83/12; E05B 83/14; E05B 83/22; E05B 2047/0048; E05B 2047/005; E05B 2047/0054; E05B 2047/0063; E05B 2047/0072; E05B 2047/0082; E05B 2047/0083; E05B 2047/0094
See application file for complete search history.

(56) References Cited

U.S. PATENT DOCUMENTS 4,083,424 A * 4/1978 von den Stemmen ..... E05B 47/026 180/272
4,866,963 A * 9/1989 Leininger ..... E05B 47/0002 70/278.2

(Continued)

*Primary Examiner* — Christopher J Boswell
(74) *Attorney, Agent, or Firm* — Luis Figarella

(57) ABSTRACT

Cargo locks are general massive, virtually armor plate grade materials, cables, tags, etc. hung on the outside of any configuration of cargo containers, enclosed cargo trucks, vans, semi-trailers, boxcars, etc. A few internal cargo area lock systems have been offered but are cost prohibitive, massive and not practical for other than a stationary installation. This makes them impractical for cargo containers, boxcars, and most semi-trailers because they are rarely re-used by the same party who invested in an elaborate "stationary" lock system. In a further development of U.S. Pat. No. 9,683,394, virtually anyone can install this flexible Lock Mechanism and Electronic Control (LM&EC) and achieve a secured cargo area by making all locks inaccessible from the outside. Similarly, the LM&EC system can be readily removed for reuse elsewhere or its access and control components modified to adapt to the reuse application or improve security for the present application.

16 Claims, 5 Drawing Sheets

The Basic Blind Vault Lock Concept

(51) Int. Cl.
*E05B 47/06* (2006.01)
*E05B 17/20* (2006.01)

(56) References Cited

U.S. PATENT DOCUMENTS 5,705,991 A * 1/1998 Kniffin ..... G07C 5/085 340/12.5
5,760,703 A * 6/1998 Becker ..... E05B 47/0012 235/380
6,049,448 A * 4/2000 Lanigan ..... E05B 47/0002 361/172
7,339,473 B2 * 3/2008 Lucas ..... B60R 25/08 340/5.7
7,950,748 B2 * 5/2011 Coutermarsh ..... E05B 51/02 188/353
8,276,415 B2 * 10/2012 Trempala ..... E05B 47/063 340/5.7
8,284,023 B2 * 10/2012 Coutermarsh ..... E05B 47/026 340/5.73
8,854,180 B2 * 10/2014 Bacarella ..... E05B 47/026 340/5.6
9,938,751 B2 * 4/2018 Chow ..... E05B 47/0009
2005/0011238 A1 * 1/2005 Roberge ..... E05B 47/02 70/256
2006/0033616 A1 * 2/2006 Silva ..... G06Q 10/08 340/539.22
2013/0081251 A1 * 4/2013 Hultberg ..... E05B 47/026 29/428
2017/0350171 A1 * 12/2017 Marasco ..... E05B 81/28

* cited by examiner

Figure 1: The Basic Blind Vault Lock Concept
Lowest Cost = 1 Locking Mechanism & Electronic Control
Total Security = 2 LM's <-- Recommended #
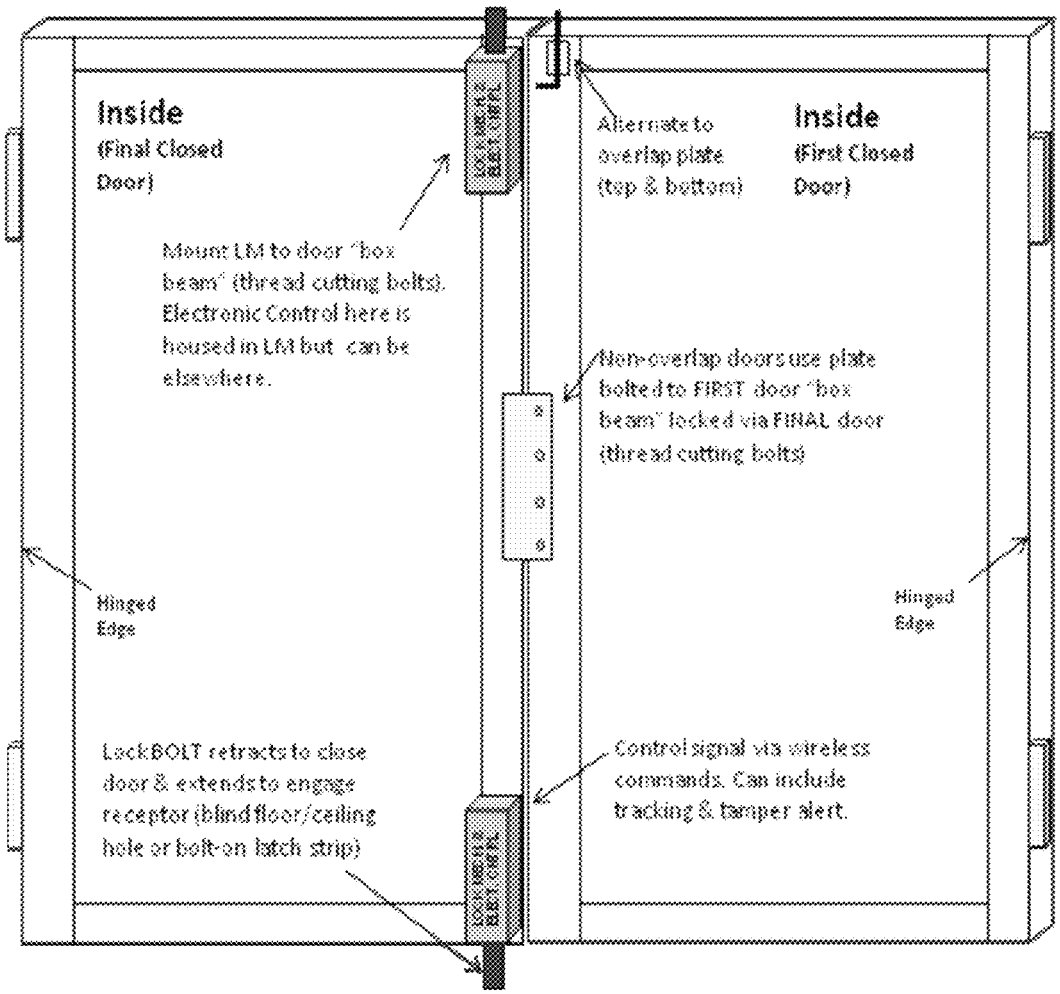
Note: At least 8 possible LM combinations are defined. This creates "blind" LM uncertainty from the outside Figure 2: Simplest & Most Likely Shapes for Engagement Locking Members
Though Many Are Possible
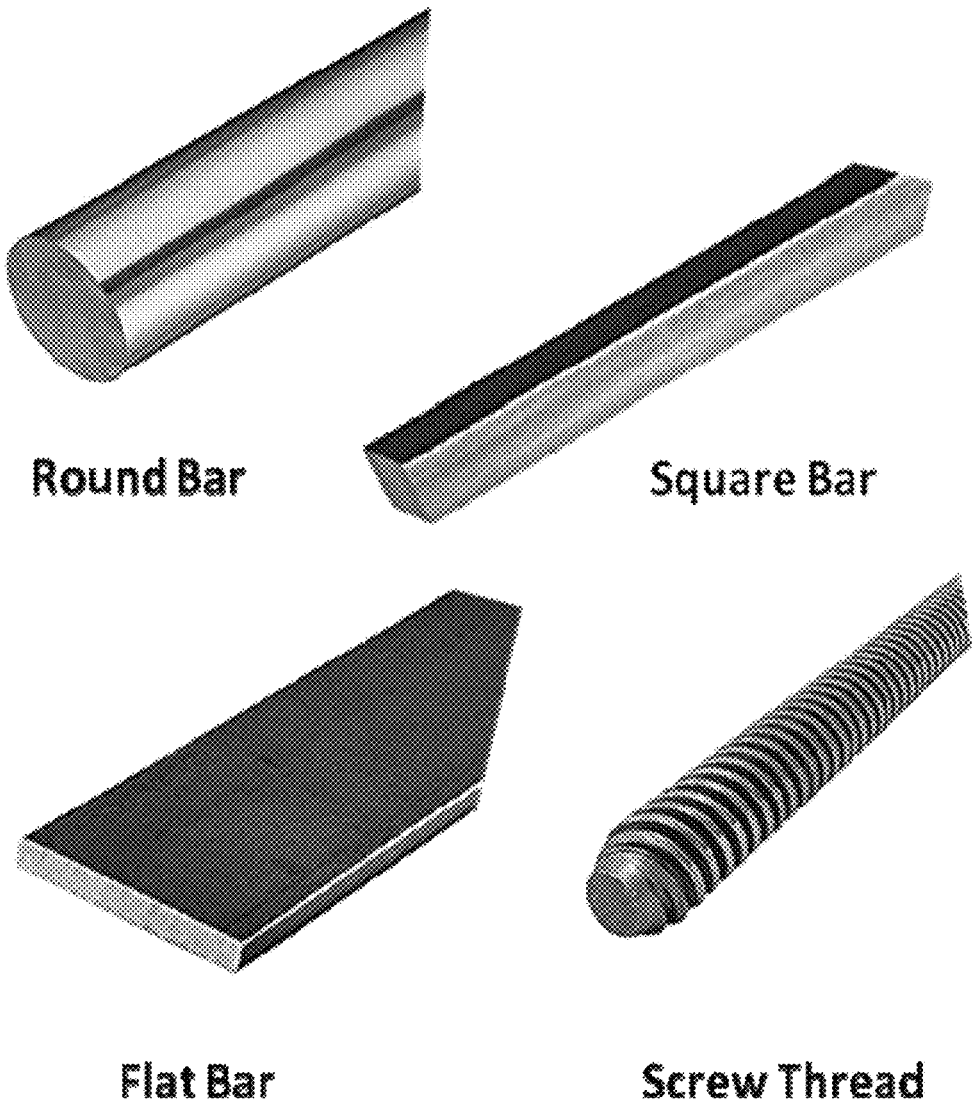

Figure 3: Engagement Locking Members
Structural Variations Are Possible
Others Variations Are Also Possible
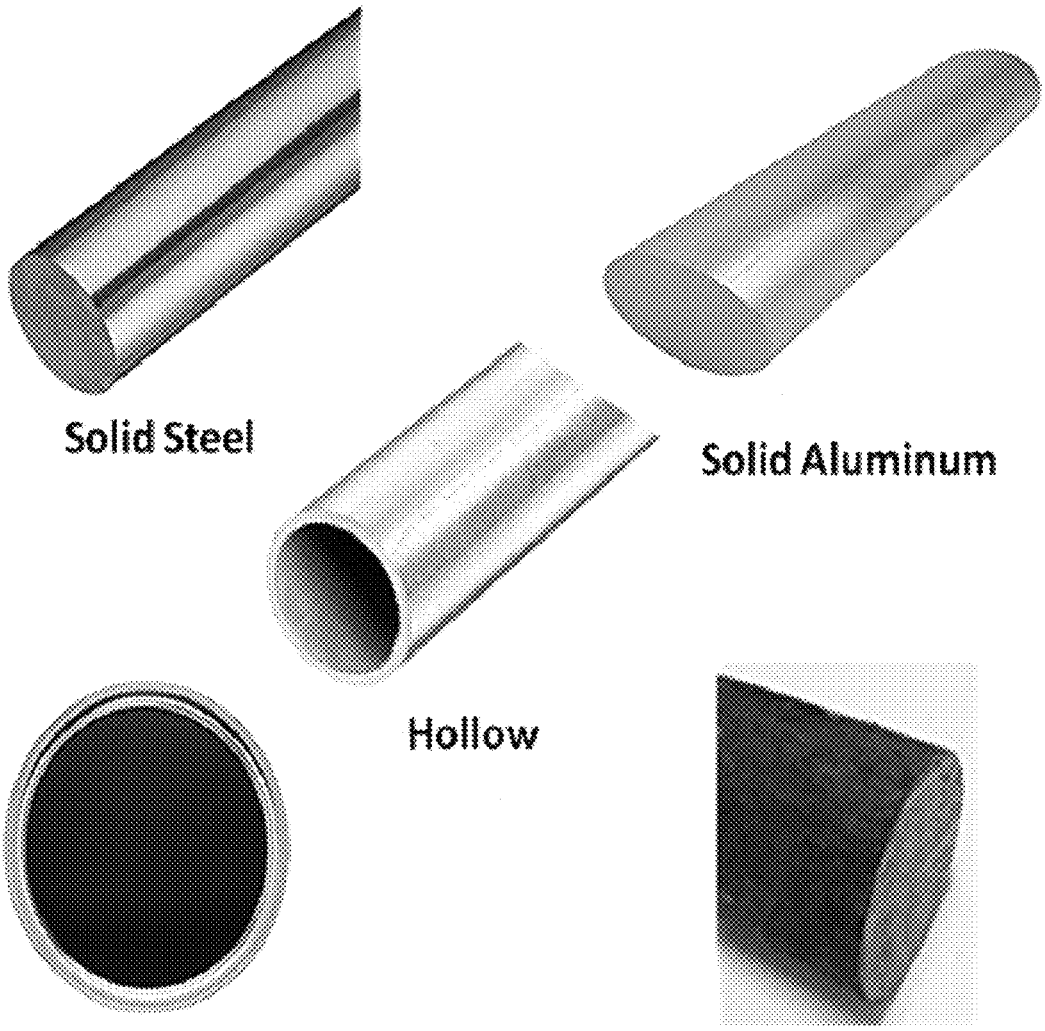

Figure 4: BVL Housing Variation Examples Provide Application Flexibility

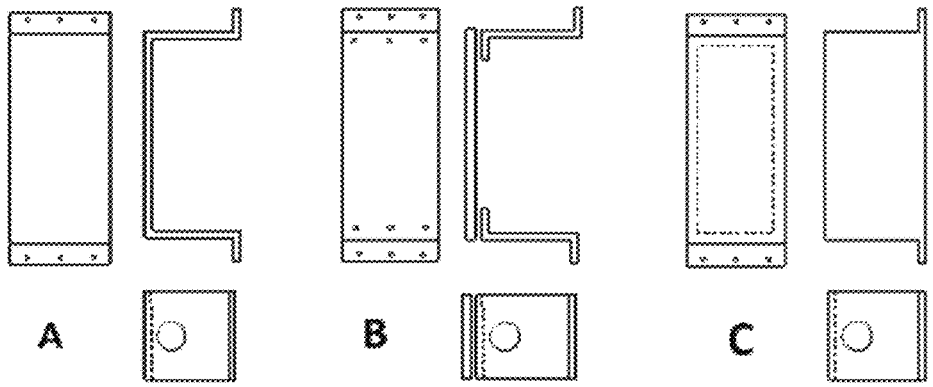

Housing Aspects:

"A" Shape:

- The simplest by utilizing a basic "C" for with folded ends & mounting holes
- The "C" shape allows for a thinner material where shifting loads are not a threat, e.g., at the top of a door; and thicker material where crushing loads are a concern.
- Longer "C" shape configurations are utilized where additional components are used.
- Not pictured, a U-shaped snap-on side cover could be used to keep out dust, etc.

"B" Shape:

- This shape has similar thickness flexibility as "A" shape
- Should just a lock bolt be used in the initial application, the upper mounting can be moved outward to defined locations to accommodate adding a wireless control unit or further out to include a self contained battery pack, with new mounting holes.
- The appropriate flat bridge plate would be selected to match the added components and fastened to the mounting brackets using the original application screws.
- A longer U-shaped snap-on side cover could be used to keep out dust, etc.

"C" Shape:

- This shape is chosen where crushing strength must be maximized.
- Flexibility still remains in that the forming could be cast, deep drawn, or even forged.
- Should a sealed application be required, the shape could be molded, gasket sealed to the mounting interface, and, even an outer "C"shape crush resistant shell utilized.

Figure 5: Modular BVL Possibilities – Samples Only
(Applies to voltage powered BVL. Similar controls apply for pneumatic, hydraulic, vacuum, magnetic, etc. BVL's)
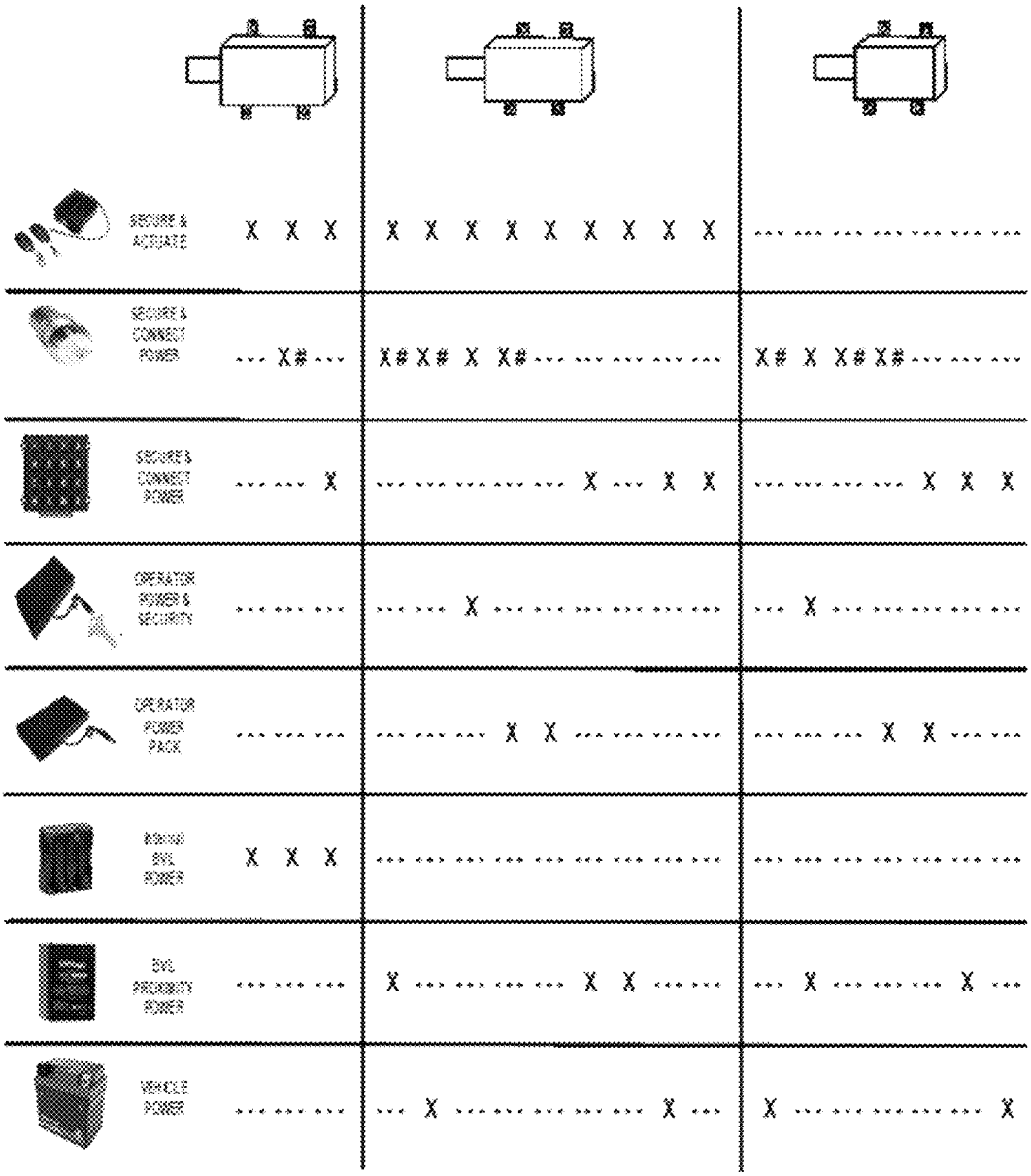

SYSTEM AND METHOD FOR SIMPLE MODULAR AND FLEXIBLE "BLIND VAULT LOCK" DESIGN TO SECURE SHIPMENT OF HIGH-VALUE CARGO

CROSS-REFERENCE TO RELATED APPLICATIONS

This application claims priority to U.S. Provisional patent application Ser. No. 62/574,779 titled "SYSTEM AND METHOD FOR SIMPLE MODULAR & FLEXIBLE "BLIND VAULT LOCK" DESIGN TO SECURE SHIPMENT OF HIGH-VALUE CARGO", filed on Oct. 20, 2018 the disclosure of which is herein incorporated by reference in its entirety.

PATENTS CITED

The following documents and references are incorporated by reference in their entirety, Joe Rickrode (U.S. Pat. No. 9,683,394), Joe Rickrode (U.S. Pat. No. 8,441,336), Jean Ramy Louis et al (U.S. Pat. No. 8,493,193), Doug Dean (U.S. Pat. Appl. No. 20130170107), Savi Technology (U.S. Pat. Nos. 8,203,451, 8,219,646 as well as U.S. Pat. Pub. No. 20090102660) and Kale Kilit (EP 2562333).

FIELD OF THE INVENTION

The invention relates to providing a variety of alternative Locking Mechanism and Electronic Control (LM&EC) module systems employing several Blind Vault Lock (BVL) options as well as power and control options where the environment and user intended objectives in which the lock system and components are utilized will dictate the types of modular components to be employed.

DESCRIPTION OF THE RELATED ART

Cargo locks are general massive, virtually armor plate grade materials, cables, tags, etc. hung on the outside of any configuration of cargo containers, enclosed cargo trucks and vans, semi-trailers, boxcars, etc. A few internal cargo area lock systems have been offered but are cost prohibitive, massive and not practical for other than a stationary installation.

The above makes them impractical for cargo containers, boxcars, and most semi-trailers because they are rarely re-used by the same party who invested in an elaborate "stationary" lock system. What is needed is a system that can be installed, be inaccessible and provides for multiple power and opening options.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

The physical Lock Mechanism (LM) modular lock system is a multi-variable, flexible combination of at least one interactive locking or securing member, herein referred to as a, bolt for security, caused to lock or unlock an access feature, typically a door, via an electrical powered actuator or other activation means, examples elsewhere listed.

For simplicity and continuity of the examples and drawings herein, electrical powered LM actuation is usually cited, thought numerous alternate actuation powering methods could be utilized.

Actuator associated power packs, remote power sources, or stored energy means, e.g., springs, energize an actuator to lock or unlock one or more locking bolts, generally but not always_controlled through commands from an electronics control package accepting commands wirelessly from an external remote control device.

In one aspect, the invention is about an inaccessible locking mechanism based system and method for securing cargo within a continuous wall enclosure, said system comprising flexible, modular internal Locking Mechanism (LM) hardware and control components configured to prevent unauthorized opening of said enclosure, including one or more engagement locking members, said LM being externally inaccessible when the enclosure is closed and one or more Electronic Control (EC) components configured to provide said LM control commands.

In another aspect, a wireless access communication module placed within said enclosure and connected to said one or more EC components wherein said one or more engagement locking member is shaped as one of round, square, flat, screw thread, solid, hollow, multi-layered, encased or similar securing member and a system power source within said enclosure. In yet another aspect, one or more external power source electrical connections reaching across said enclosure walls into said internal system components. In another aspect, one or more external connecting ports, keyhole or keypads having electrical connections reaching across said enclosure walls for operating said internal components. In yet another aspect, one or more external power source electrical connections reaching across said enclosure walls into said internal system components.

In another aspect it is about a plurality of LM's, each of the LM's including a secure, such as bolted on, anchoring or attachment configuration, such that for the potential plurality of container types wherein the LM is utilized, at least one LM is used to secure the access from unapproved entry. In such applications, all of the potential plurality of LM's employed having a common control configuration simultaneously causing all interconnected LM's to actuate causing a lock or unlock activation to occur.

This flexible modularized LM system is also adaptable to utilizing more than one control configuration such that not all LM's are lock, or more importantly unlocked by a single control configuration, but rather multiple configuration might be required.

In the simplest aspect, the invention is about a readily attachable, removable, & transportable wirelessly controlled LM module with associated power pack and wireless controller access securing system adaptable to containers for cargo.

Other features and advantages of the present invention will become apparent upon examining the following detailed description of an embodiment thereof, taken in conjunction with the attached drawings.

BRIEF DESCRIPTION OF THE DRAWINGS

FIG. 1 shows the key FUNCTIONAL CONCEPTS conveyed in U.S. Pat. No. 9,683,394, as a "basic" exemplary embodiment of the invention.

FIG. 2 conveys just a few variations of "bolt" examples. The possibilities are endless.

FIG. 3 conveys that the potential variations in the lock bolt materials and composition can be aligned with the application demands. Just a few examples include a hollow pipe-like member, solid member, aluminum, carbon fiber or even a composite of multiple materials.

FIG. 4 shows a few variations possible for the primary lock housing and mounting support allowing upgrading to stronger alternatives while utilizing the same mounting footprint. Also, an expandable alternative exists which is capable of containing more internal components as requirement change.

FIG. 5 shows the robust nature of this modular system. Components can be readily added to achieve the desired control levels. In addition, control system designs and involved components can be totally revised while utilizing the same Blind Vault Locking mechanism.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

A single securing application may dictate a variety of lock, power, and control alternatives to achieve the desired end, hence the modular, building block concept, which permits changes to the power and control alternatives should application requirements or security needs so dictate.

The use of the term bolt or lock bolt throughout is a generic reference to any means or methods allowing an area to be secured or even preventing inadvertent lockup or securing to occur, if the application so dictates. Such means or methods may involve sliding or rotation action, pneumatics, electromagnetic, hydraulics, spring force, or any combination of these or similar to produce the desired action(s). Perhaps during high activity times, preventing lockup is desired but at the end of a high usage period lockup is desired, e.g., over night, in-transit, outside non-employees in the area.

The use of the term container throughout is a generic reference to any form or shape of enclosed space suitable for storage of any solid, liquid, or gaseous material or substance for the purpose of containment and prevention of access, alteration or removal unless so authorized.

The use of the term wireless throughout is a generic reference to any non-contact means or methods capable of sending or receiving and responding to a non-contact communication, typically an action instruction or confirmation of action taken. The action employed with the lock bolt can be linear movement, rotational, cam, hook, magnetic, etc. Any action or activity to achieve lock and unlock functions.

The use of the term power or activate can be any form, means methods to achieve a desired action be it electrical (AC or DC), pneumatic, hydraulic, magnetic, kinetic or potential energy, just to name a few.

The broad range of environments in which this LM&EC hidden lock concept might be utilized may cause moisture degradation of electronic components, should the wireless control system be selected, or corrosion of wire connections or circuit board components occur.

If any of the components utilized in the LM&EC system might be operationally effected by the environment in which they operate or be stored, suitable means for protecting such components may be utilized or potentially adversely affected components might be removable then restored later when lock operation is required.

When the Lock Mechanism and Electronic Control (LM&EC) system is to be applied to a delivery type cargo truck or van, it may not be the most practical choice to power the LM&EC via an integral modular power pack approach where frequent battery changes would be necessary.

In an enclosed cargo truck bed, the vehicle's DC voltage source elsewhere located may be used to power the lock and unlock actions of Blind Vault Lock (BVL) but utilize a wireless remote or a specialty key-like device to trigger or control such actions.

Should the lock and unlock action be powered by pneumatic, hydraulic, vacuum, etc., such sources can be elsewhere located or in proximity of the LM while electromagnetic actuation would generally be local to the LM.

If a remotely located, hidden access control point or a virtually impossible to duplicate locking and/or release device, probe, bar, specialty key, etc. was provided, the LM's unlock actuation would avoid destroying the doors or LM to gain access. Many such relevant features could be located in an enclosed cargo area vehicle.

Much like the virtually impossible to duplicate locking pattern combinations for expensive auto wheel locks, similar nearly impossible to duplicate methods could be employed for this hard to locate and/or virtually impossible to duplicate the LM release bolt proposed herein.

The LM's actuating lock bolt approach, equivalent to a safe/vault bolt, will provide secured cargo area lockup for many years such that the system's lock/unlock battery power pack and/or electronics package may decline to a point of being ineffective for unlocking and/or subsequent locking again. An unlock alternative which avoids door or hinge destruction, would be more desirable and practical.

If a cargo container, truck, trailer, boxcar, etc. are "pre-planned" to sit unopened for long periods, perhaps years, in a military or emergency responder, hurricane or tornado support role, an onboard modular battery pack would not be a wise choice since battery power decay over time in likely. Anticipating such extended periods of idle storage, the internal wireless module can be appropriately protected for such periods and actuation power provided through an access port to cause the LM bolt unlock actuation triggered by the container's remote control.

In another embodiment, if containers might sit dormant for unknown periods in hostile, contaminated environments, it may cause degradation of the wireless control circuitry in the LM&EC such that pre-planning means of alternative triggering of the LM unlock actuation would avoid destroying the doors or hinges to gain access.

The modular locking design set forth in U.S. Pat. No. 9,683,394, includes possibly using a single Blind Vault Lock (BVL) bolt in the simplest Lock Mechanism and Electronic Control (LM&EC) execution and expanding to multiple LM modules to achieve the desired, elevated security level.

These can vary in complexity from a single "slave" actuated LM without any included/attached power pack, power source, or electronics up to one or more "master" LM&EC's controlling the total internal locking solution of up to eight (8) LM's located in a variety of positions.

It should be noted that the maximum possible LM solution would put lock modules on the four corners of each door present such that removing a container's outer hinges and any cam locking handles present would still not release the door for access but rather the door would still be securely locked in place by eight inaccessible LM's.

Where more than 1 LM is employed, it is possible for more than one EC to be utilized for controlling the LM's, further increasing the security of the system.

The physical BVL bolt may be similar to a hollow pipe section or a solid vault-like bar or similarly strong alternate configuration, fashioned from ferrous or non-ferrous materials, perhaps customized to user's choice for a truck fleet, military spec, or similar.

Some applications involving the transport of chemicals or similar potentially hazardous solid, liquid or gaseous materials can readily utilize a carbon fiber or similar non-sparking outer bolt surface encasing a ferrous, non-ferrous metallic bolt core or similarly strong alternate configuration for strength.

The LM bolt simplicity and bolt to actuator mounting coupling is intended to allow fleet level end users with maintenance facilities to fashion their own LM bolts and actuator coupling hardware when repair or replacement seems appropriate.

The LM&EC main structural outer frame member can be of varying material thicknesses, especially where shifting loads may apply crushing pressures to a Lock Mechanism installed at the bottom of a door.

The LM&EC main support frame is defined in such a way that it can be a single piece fabricated, cast, forged, etc. support frame or a similarly created upper and lower support member each having container door mounting features. This two piece support member approach would be tied together by a bridging member joining and aligning the upper and lower support members. The bridging member may also include mounting features in select applications.

The bridging member joining the upper and lower support member could be short for applications just housing a LM bolt and an actuation device.

Alternatively, a longer bridging member would be utilized if the resulting frame was to be a full LM&EC assembly, including a power pack and/or control module in addition to the LM bolt and actuation device.

The above support frame alternatives can be a shallow profile to minimize the LM&EC package size for the least protrusion into the cargo space by utilizing a higher LM&EC profile.

Alternatively, a deeper LM&EC profile can be utilized to permit a short height package for containing the LM bolt, actuator, plus power pack and/or electronics, if so dictated for the desired lock system execution.

A single unitized, e.g., cast, forged or similarly formed, enclosure could also be utilized for housing said components combinations if desired.

If the wireless control feature is not wanted or needed, perhaps in a local cargo delivery application, the forward and reverse motion of the LM bolt may result from a switching device elsewhere located or near the LM, or both for redundancy. Many low voltage, pneumatic, hydraulic, vacuum, electromagnetic, etc. switching devices of a variety of configurations can fulfill this need.

This action may be controlled by manual, electronic or wireless actuation of one or more devices elsewhere located, perhaps by a cargo truck driver, helper, or both or even by someone not on site. Such actuation systems may involve a key like system, hidden switch, key pad or similar master or multiple code entry, voice, fingerprint or retina type controls. Some cell phone actuation methods exist as well.

Multiple sequential or simultaneous actions may be involved. One individual energizing the system, i.e., provides remote power to the LM from the vehicle's power source, main or auxiliary battery, while another individual activates the LM bolt actuator device. The combinations and variations are limitless today. Other lock and unlock powered modes can have similar sequential or simultaneous actions be utilized.

Security methods and defined procedures dealing with permutations, combinations of actuation sequences, hidden switches, other specialty devices, generally called keys but often not resembling a key in the traditional sense. For example, the key, lock/unlock device, may also be configured to conduct power for actuating the LM's involved after the unlock motion is confirmed.

There are even systems and adaptable component elements existing where an individual carries a transmission device on their person such as in a pocket, around their neck, etc., which emits a signal to a receiver somewhere, likely hidden, on the cargo transport. Until the receiver gets this remotely transmitted signal, various devices, circuits, etc. remain non-functional.

Signal emitting devices typically but not exclusively apply to military, government agent, or bonded agent applications. In such situations, the individuals involved might well carry a unique key device which is critical to energizing the circuit controlling the internal cargo area LM&EC components.

A broad variety of high security applications may dictate simultaneous and/or sequential use of a key and wireless remote to release the lock, as well as in many of the foregoing points.

Any locking alternatives implied or described herein are intended to be totally compatible with and utilized in conjunction with U.S. Pat. No. 9,683,394 "Simplified System and Method for Secure Shipment of High-Value Cargo." Beyond the alternative lock control aspects described and potentially conveyed via any supporting drawings herein, all other aspects should be drawn from the cited patents.

Referring to FIGS. 1-5 we illustrate how the present invention is a system for providing maximum system flexibility through simple modular components adapted for protecting valuable cargo, typically in-transit to or from somewhere. It can readily be recognized that this modular lock and control approach can easily adapt to stationary or semi-stationary storage areas, such as military drop zones, construction sites, material storage removed from high activity human traffic areas, transport and extended storage in virtually any size or shape of cargo enclosure, collectively cargo containers, panel trucks, cargo and tank semi-trailers and boxcars.

The modular internal/inaccessible locking approach permits adapting solutions for all such applications for high-value cargo while simultaneously preserving the natural protection which arises due to the shipment security being externally totally indistinguishable from the large majority of similar shipments which are likely not carrying high value cargo or "hiding in plain sight as afforded by the internal BVL system."

FIG. 1 pictorially conveys the key aspects typically exemplifying applications relating to cargo containers, semi-trailers, and other any similar access geometry. This system can substantially reduce cargo theft by removing the locking devices from access and visibility. This is the weakest link in today's transport of goods be it import/export or from port or distribution center to the next destination.

Abroad variety of containers for cargo transport presently exist but in all cases the container door or access hatch on a tank container are mounted to a structurally strong frame structure. All such structures will typically accommodate inaccessible locking features and control methods as the subsequent drawings suggest.

FIG. 2 conveys that "bolt" is utilized as a generic term herein. The member or device achieving the desired functions of: lock or engage, unlock or disengage, can be of any shape of form or a combination of same suitable for achieving the desired action or end point, even threaded solutions can apply.

Configurations can readily be adapted to the application, can be customized to the needs or preferences of the user, perhaps dictated by user's Maintenance Shop skill levels or available equipment therein, (e.g., in a truck fleet). Roll-up door applications may be more secure with a configuration adapted to that application, such as a rotating screw member, versus hinged swing doors where an engaging bar may suffice.

FIG. 3 conveys any lock bolt configuration may have unique needs such as hollow for weight reduction, steel instead of aluminum for higher bending and shear strength, aluminum used in moisture prone environments or for insulation properties where static arcing of electrical conductivity must be prevented.

FIG. 4 Provides a few examples of how the primary BVL mounting can be varied to suit both the application and budget of the user while utilizing the same mounting footprint. All configurations allow for the BVL mounting package to be readily removed and replaced via readily accessible fasteners.

FIG. 5 suggests virtually any elements can be adapted to a DC supply voltage. AC supply voltage could be utilized if compatible AC components were used throughout. Various switch functions may be desired, e.g., on/off to energize the LM system, perform actual LM lock/unlock actuation, operated separately or in combination with one or more wireless controls. Keyed system access can also be utilized. A number of sophisticated key like devices exist today which virtually prevent duplication and/or picking a lock or control switch unit. Magnetic strip and chip cards are also adaptable.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

I claim:

1. An inaccessible locking mechanism based system for securing cargo within a continuous wall enclosure, said system comprising:

flexible, modular Locking Mechanism (LM) hardware and control components mounted completely within within a door structure of said enclosure, said LM configured to prevent unauthorized opening of said enclosure, including one or more engagement locking members, said LM being externally inaccessible when the enclosure is closed;

one or more Electronic Control (EC) components configured to provide said LM activation commands, said ECs also located within said enclosure;

a wireless access communication module completely located within said enclosure and connected to said one or more EC components;

wherein said one or more engagement locking member is shaped as one of:

round, square, flat, screw thread, solid, hollow, multi-layered, encased or similar securing member; and a system power source completely located within said enclosure.

2. The system of claim 1 further comprising;

one or more electrical power transmitting connections reaching across said enclosure or door structure into said internal system components.

3. The system of claim 2 further comprising;

one or more external connecting port, keyhole, lock cylinder, sequential access, hidden switch or fingerprint activation components transmitting along said electrical connections for activating said internal components.

4. The system of claim 1 further comprising;

a wireless access communication module completely located within said enclosure and connected to said one or more EC components;

wherein said LM components are mechanically linked to a door structure, said one or more engagement locking member is shaped as one of:

round, square, flat, screw thread, solid, hollow, multi-layered, encased or similar securing member; and one or more electrical power transmitting connections reaching across said enclosure or door structure into said internal system components.

5. An inaccessible locking mechanism based system for securing cargo within a continuous wall enclosure, said system comprising:

flexible, modular Locking Mechanism (LM) hardware and control components mounted completely within said enclosure, said LM configured to prevent unauthorized opening of said enclosure, including one or more engagement locking members, said LM being externally inaccessible when the enclosure is closed;

one or more Electronic Control (EC) components configured to provide said LM activation commands, said ECs also located within said enclosure;

one or more electrical power transmitting connections reaching across said enclosure into said internal system components;

wherein said one or more engagement locking member is shaped as one of:

round, square, flat, screw thread, solid, hollow, multi-layered, encased or similar securing member; and one or more external connecting port, keyhole, lock cylinder, sequential access, hidden switch or fingerprint activation components transmitting electrical power along said electrical connections for activating said internal components.

6. The system of claim 5 wherein:

any external key-like activation components are connected to the components inside said enclosure through said electrical power transmitting key-like functional member.

7. The system of claim 6 further comprising;

a wireless access communication module completely located within said enclosure and connected to said one or more EC components.

8. The system of claim 5 wherein:

a wireless access communication module completely located within said enclosure and connected to said one or more EC components; and an external power source connected to said one or more electrical power transmitting connections is comprised of a remote battery, portable power pack, an extension cord and/or other suitable power source.

9. An inaccessible locking mechanism based method for securing cargo within a continuous wall enclosure, said method comprising:

providing a flexible, modular Locking Mechanism (LM) hardware and control components mounted completely within said enclosure's door structure, said LM configured to prevent unauthorized opening of said enclosure, including one or more engagement locking members, said LM being externally inaccessible when the enclosure is closed;

providing one or more Electronic Control (EC) components configured to provide said LM activation commands, said ECs also located within said enclosure;

providing a wireless access communication module completely located within said enclosure and connected to said one or more EC components;

wherein said one or more engagement locking member is shaped as one of:

round, square, flat, screw thread, solid, hollow, multi-layered, encased or similar securing member; and providing a system power source completely located within said enclosure.

10. The method of claim 9 further comprising;

providing one or more electrical power transmitting connections reaching across said enclosure or door structure into said internal system components.

11. The method of claim 10 further comprising;

providing one or more external connecting port, keyhole, lock cylinder, sequential access, hidden switch or fingerprint activation components transmitting along said electrical connections for activating said internal components.

12. The method of claim 9 further comprising;

providing a wireless access communication module completely located within said enclosure and connected to said one or more EC components;

wherein said LM components are mechanically linked to a door structure, said one or more engagement locking member is shaped as one of:

round, square, flat, screw thread, solid, hollow, multi-layered, encased or similar securing member; and providing one or more electrical power transmitting connections reaching across said enclosure or door structure into said internal system components.

13. An inaccessible locking mechanism based method for securing cargo within a continuous wall enclosure, said method comprising:

providing flexible, modular Locking Mechanism (LM) hardware and control components mounted completely within said enclosure, said LM configured to prevent unauthorized opening of said enclosure, including one or more engagement locking members, said LM being externally inaccessible when the enclosure is closed;

providing one or more Electronic Control (EC) components configured to provide said LM activation commands, said ECs also located within said enclosure;

providing one or more electrical power transmitting connections reaching across said enclosure into said internal system components;

wherein said one or more engagement locking member is shaped as one of:

round, square, flat, screw thread, solid, hollow, multi-layered, encased or similar securing member; and providing one or more external connecting port, keyhole, lock cylinder, sequential access, hidden switch or fingerprint activation components transmitting along said electrical connections for activating said internal components.

14. The method of claim 13, wherein;

any external key-like activation components are connected to the components inside said enclosure through said electrical power transmitting key-like functional member.

15. The method of claim 14 further comprising;

providing a wireless access communication module completely located within said enclosure and connected to said one or more EC components.

16. The method of claim 13 wherein;

providing a wireless access communication module completely located within said enclosure and connected to said one or more EC components; and an external power source connected to said one or more electrical power transmitting connections is comprised of a remote battery, portable power pack, an extension cord and/or other suitable power source.

* * * * *